US008113395B2

(12) United States Patent
Norris

(10) Patent No.: US 8,113,395 B2
(45) Date of Patent: Feb. 14, 2012

(54) GARMENT DONNING ASSIST DEVICE

(76) Inventor: Michael Ron Norris, Irmo, SC (US)

( * ) Notice: Subject to any disclaimer, the term of this patent is extended or adjusted under 35 U.S.C. 154(b) by 474 days.

(21) Appl. No.: 12/197,792

(22) Filed: Aug. 25, 2008

(65) Prior Publication Data

US 2009/0114686 A1 May 7, 2009

Related U.S. Application Data

(60) Provisional application No. 61/001,736, filed on Nov. 5, 2007.

(51) Int. Cl.
*A47G 25/80* (2006.01)

(52) U.S. Cl. ..... 223/111

(58) Field of Classification Search ..... 223/1, 120, 223/111–112
See application file for complete search history.

(56) References Cited

U.S. PATENT DOCUMENTS

| | | | | |
|---|---|---|---|---|
| 3,853,252 | A * | 12/1974 | Scianimanico | 223/111 |
| 5,082,154 | A * | 1/1992 | French | 223/112 |
| D337,881 | S | 8/1993 | Peeler | |
| 5,405,109 | A * | 4/1995 | Nordnes | 248/118.3 |
| 5,566,030 | A | 10/1996 | Yue | |
| 5,630,534 | A | 5/1997 | Maier et al. | |
| 5,632,424 | A | 5/1997 | Maier et al. | |
| 5,769,289 | A | 6/1998 | Lusk | |
| 6,419,131 | B1 * | 7/2002 | Rix | 223/111 |
| 6,852,089 | B2 | 2/2005 | Kloecker et al. | |
| 7,070,074 | B2 | 7/2006 | Landsberger et al. | |
| 7,135,007 | B2 | 11/2006 | Scott et al. | |
| 7,364,056 | B2 * | 4/2008 | Boaron | 223/111 |
| 2007/0170214 | A1 * | 7/2007 | Kelly | 223/111 |
| 2009/0242593 | A1 | 10/2009 | Hildebrandt | |

OTHER PUBLICATIONS

International Search Report PCT/US2008/082419, completed Nov. 5, 2008 and mailed Apr. 24, 2009.

* cited by examiner

*Primary Examiner* — Shaun R Hurley
*Assistant Examiner* — Andrew Sutton
(74) *Attorney, Agent, or Firm* — Dority & Manning, P.A.

(57) ABSTRACT

A compression garment upper extremity donning assist device is designed to assist those individuals who find it very difficult to don a compression garment using only one arm. Users are commonly weakened from a medical condition, lack flexibility or suffer from limited mobility. Due to the design, users of the donning device can easily mount it to the edge of any countertop, table, or level flat surface using the integrated suction cup. The user can then pull any type of upper extremity compression garment over the device, and then, by pushing through the garment stretched over the donning device, roll it up the arm for proper location and medical care compliance.

23 Claims, 6 Drawing Sheets

GARMENT DONNING ASSIST DEVICE

RELATED APPLICATIONS

The present application is based upon and claims priority to a previously filed U.S. Provisional Patent Application Ser. No. 61/001,736 and filed on Nov. 1, 2007.

BACKGROUND

Those suffering from lymphatic and/or circulatory disorders are commonly prescribed a compression garment for wear to help in the reduction and management of swelling and circulation in their extremities. For example, compression garments configured to surround one's arm or leg are typically used to treat lymphedema. Lymphedema is an accumulation of lymphatic fluid resulting from impairment of the lymphatic transport system. Lymphatic fluid can build up in different affected areas of the body, especially in the arms and legs. Lymphedema can cause pain, chronic inflammation, fibrosis, and reduced mobility. In this regard, compression garments are typically placed over the affected extremity in order to counteract fluid build-up.

Compression garments, such as compression sleeves, compression gauntlets, and compression stockings, are typically made from an elastic material. The elastic material, for instance, may comprise an elastic knitted woven material.

In order for the compression garments to function properly, the garments are typically designed to cover substantially the entire extremity. For example, compression sleeves typically cover the entire arm extending from the wrist to the shoulder of the wearer. Similarly, compression stockings typically extend from the foot to the hip of the wearer although knee-high stockings are also available. Selecting a compression garment with the appropriate amount of compression is critical to successfully treating lymphedema or other circulatory diseases. If the garment provides too little compression, for instance, the garment may be ineffective in preventing fluid build-up. Too much compression exerted by the garment, on the other hand, can damage the tissues.

Compression garments are typically not worn while sleeping. If worn while sleeping, for instance, the garment may provide too much compression when the body is inactive. Most compression garments also need to be replaced every four to six months since the elastic properties of the garments tend to degrade. Thus, compression garments normally have to be removed and applied at least once during the day. Unfortunately, most patients prescribed these highly elastic garments find it difficult to don them. While donning the arm sleeve, one arm is rendered useless while the opposite arm is left to pull on the garment. Not only is the individual trying to use one arm for a traditionally two arm event, the patient may be further compromised by skin integrity, immobility, inflexibility, obesity, weakened from a medical condition or suffer from limited mobility or other condition limiting their ability to properly don the extremity compression garment.

In order to improve and facilitate the donning of compression garments, in the past, it was recommended to apply a thin layer of cornstarch or powder to the extremity prior to placing the compression garment on the extremity. Some manufacturers also recommend wearing rubber or vinyl gloves while putting on the compression garment to provide a better grip on the fabric and to prevent one's fingernails from damaging the fabric or one's skin.

In view of the above problems experienced in donning compression garments, however, a need currently exists for a device and a method for facilitating application of a compression garment onto one's extremities.

SUMMARY

In general, the present disclosure is directed to an extremity garment donning assist device that is designed to assist an individual in donning a compression garment onto an extremity without needing assistance from a caregiver. The garment donning assist device of the present disclosure is particularly well suited to providing assistance to those who may be suffering from a medical condition and lack flexibility or suffer from limited mobility.

In one embodiment, for instance, the present disclosure is directed to an extremity garment donning assist device that includes a rigid frame having a top, a bottom and a pair of opposing side walls. The side walls extend outwardly to define an open channel that extends from the top to the bottom of the rigid frame. In one embodiment, for instance, the side walls are curved such that the rigid frame has an arcuate-shaped cross section. In this manner, the rigid frame has an open cylindrical configuration. For instance, the arcuate-shaped cross section can form an open channel that has walls extending from about 120° to about 210°, such as from about 150° to about 175°.

At least one mounting member is connected to the rigid frame for mounting the rigid frame against a surface. The rigid frame has a size such that a compression sleeve can be slid over the top of the frame leaving an outstretched opening. The outstretched opening can allow for a person to slide an extremity, such as one's arm or leg, into the compression sleeve for donning the same.

The rigid frame of the garment donning assist device can be made from different materials. For example, in one embodiment, the rigid frame may comprise an open frame having a cage-like design made from metal rods, metal bars, plastic members or combinations thereof. Alternatively, the rigid frame may be made from a solid plastic or metal member. The solid plastic member can be made from any rigid polymeric material, such as a polyester polymer or copolymer. In one embodiment, when the rigid frame is made from a solid plastic member, the plastic member may include a first side that defines the open channel and has a smooth surface for allowing one's arm or leg to slide through the device. The second side of the plastic member, on the other hand, can have a textured surface that maintains the compression sleeve in position as the compression sleeve is being donned.

The mounting member connected to the rigid frame can vary depending upon the particular application and various factors. In one embodiment, for instance, the mounting member may comprise a suction cup. In an alternative embodiment, the mounting member may comprise a clamp, such as a C-clamp. In still another embodiment, the garment donning assist device may include a pair of mounting members that comprise legs. The legs, for instance, may extend from the rigid frame for holding the frame above the floor. When the mounting members comprise legs, in one embodiment, the garment donning assist device may further include a pair of opposing handles that extend from the legs. The handles may be used, for instance, in order to support oneself and insert a leg into a compression garment, such as a stocking, that has been placed over the rigid frame.

The mounting member can be connected to the rigid frame so as to only have a single fixed position. For instance, in one embodiment, an extension member may be used to connect a suction cup to the rigid frame for releasably affixing the garment donning assist device to a horizontal surface, such as a table or counter. Alternatively, the mounting member may be movable in relation to the rigid frame for mounting the device on a horizontal surface or a vertical surface depending upon the particular environment. In this embodiment, for instance, the mounting member may pivot in relation to the rigid frame for assuming a horizontal position or a vertical position.

As described above, the rigid frame includes side walls that define an open channel that extends from the top of the frame towards the bottom of the frame. In one embodiment, the channel can have substantially the same size from the top of the frame to the bottom. Alternatively, the rigid frame can be configured so that the channel tapers from the top to the bottom. For instance, in one embodiment, the channel may have a narrower dimension towards the bottom of the rigid frame.

In one particular embodiment, the garment donning assist device may be particularly well suited to assist users in donning upper extremity compression sleeves on their arms. A rigid material is formed in a half cylindrical shape attached to a suction cup for mounting on smooth, flat surfaces to assist with donning. Utilizing the suction cup allows the design to be portable and able to be used in more than one location. With the device suctioned to a flat surface, the user is able to slide the upper extremity compression garment over the rigid form of the device leaving an outstretched opening into which they can put their arm to easily don the upper extremity compression garment. The stretching of the material allows the user to slide their arm into the garment and properly place the garment before releasing the compression. By pushing down through the garment, it is easily rolled off the device and up the arm for optimum body placement.

Advantages of the invention are to provide users with a device that is simple to use in order to don an upper extremity compression garment. The device allows one to overcome any individual weaknesses, inflexibility or limited mobility.

The present disclosure is also directed to a process for donning a compression sleeve. The process includes the steps of placing a compression sleeve over the garment donning assist device as described above. The compression sleeve is placed over the top of the rigid frame and pulled down the device so as to form an outstretched opening. An extremity, such as an arm or a leg, is then inserted into the outstretched opening of the compression sleeve. The extremity is used to push down through the compression sleeve thereby causing the compression sleeve to slide up and off the rigid frame and over the extremity.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
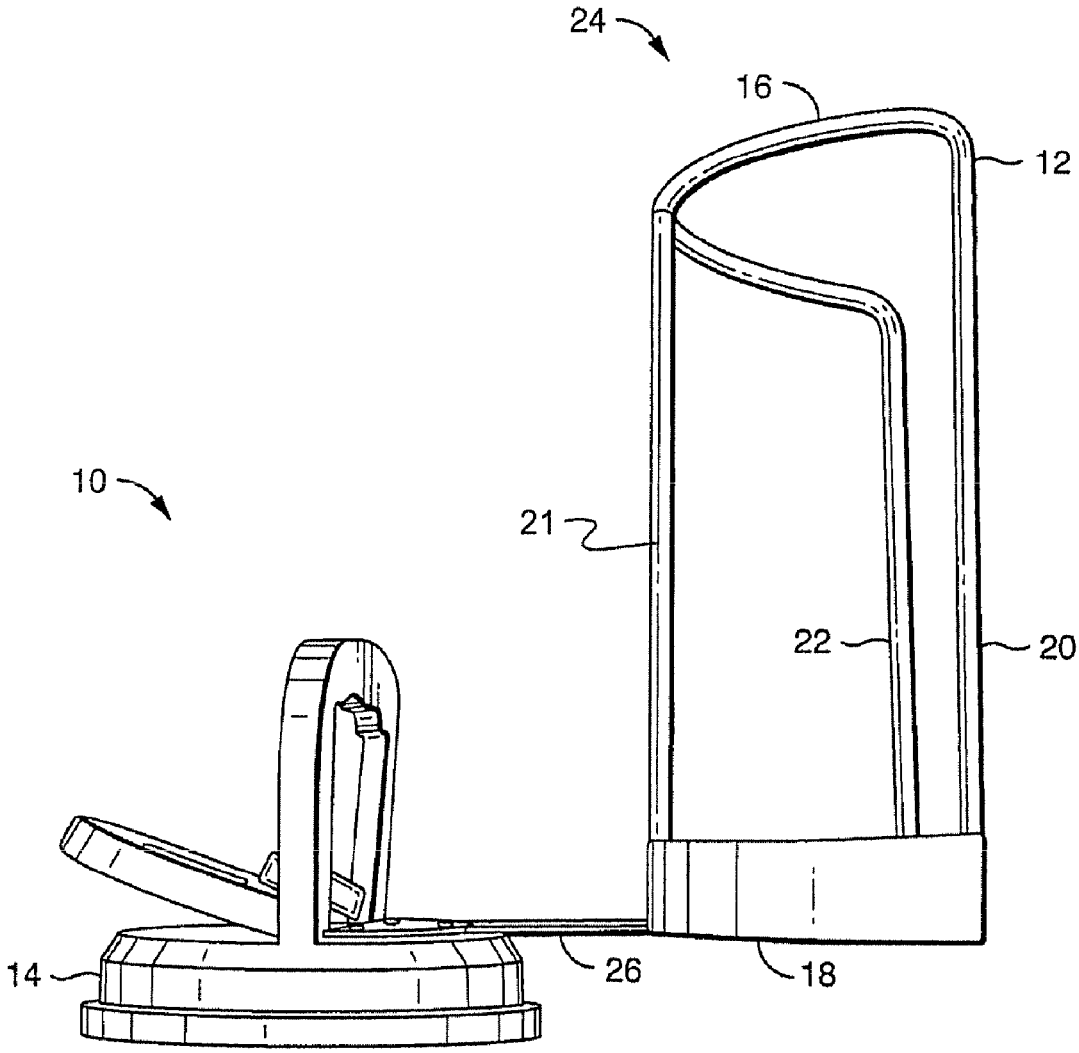
FIG. 1 is a side perspective view of one embodiment of an extremity garment donning assist device made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to a garment donning assist device that is particularly well suited for applying compression garments, such as compression sleeves, compression gauntlets, and compression stockings on to the extremities of a wearer. Such compression garments are typically prescribed to those suffering from lymphedema or circulatory disorders. The compression garments are intended to provide compression to an extremity, such as an arm or leg, for preventing fluids from accumulating within the treated region. Compression garments, in order to provide the needed therapy, are highly elastic and somewhat difficult to place over one's arm or leg without the assistance of a caregiver. Further, since many individuals using compression garments suffer from lymphedema or circulatory diseases, the problems associated with donning the garments become exacerbated due to the health state of the wearer. For instance, individuals suffering from the above conditions are often in pain and suffer from chronic inflammation, reduced mobility and may also even suffer from skin ailments.

In this regard, the present disclosure is directed to a garment donning assist device that not only assists an individual in placing a compression garment on an extremity, such as an arm or leg, but also serves to ensure that the garment is properly located and positioned on the extremity to be treated. For example, referring to FIGS. 1 and 2, one embodiment of a compression garment donning assist device 10 is shown. As illustrated, the garment donning assist device 10 includes a rigid frame 12 connected to a mounting member 14.

The frame 12 includes a top 16, a bottom 18, a pair of extending side walls 20 and 22 and a back stabilizing member or wall 21. The side walls 20 and 22 extend in a manner that forms an open channel 24 as shown in FIG. 1.

Figure 2:
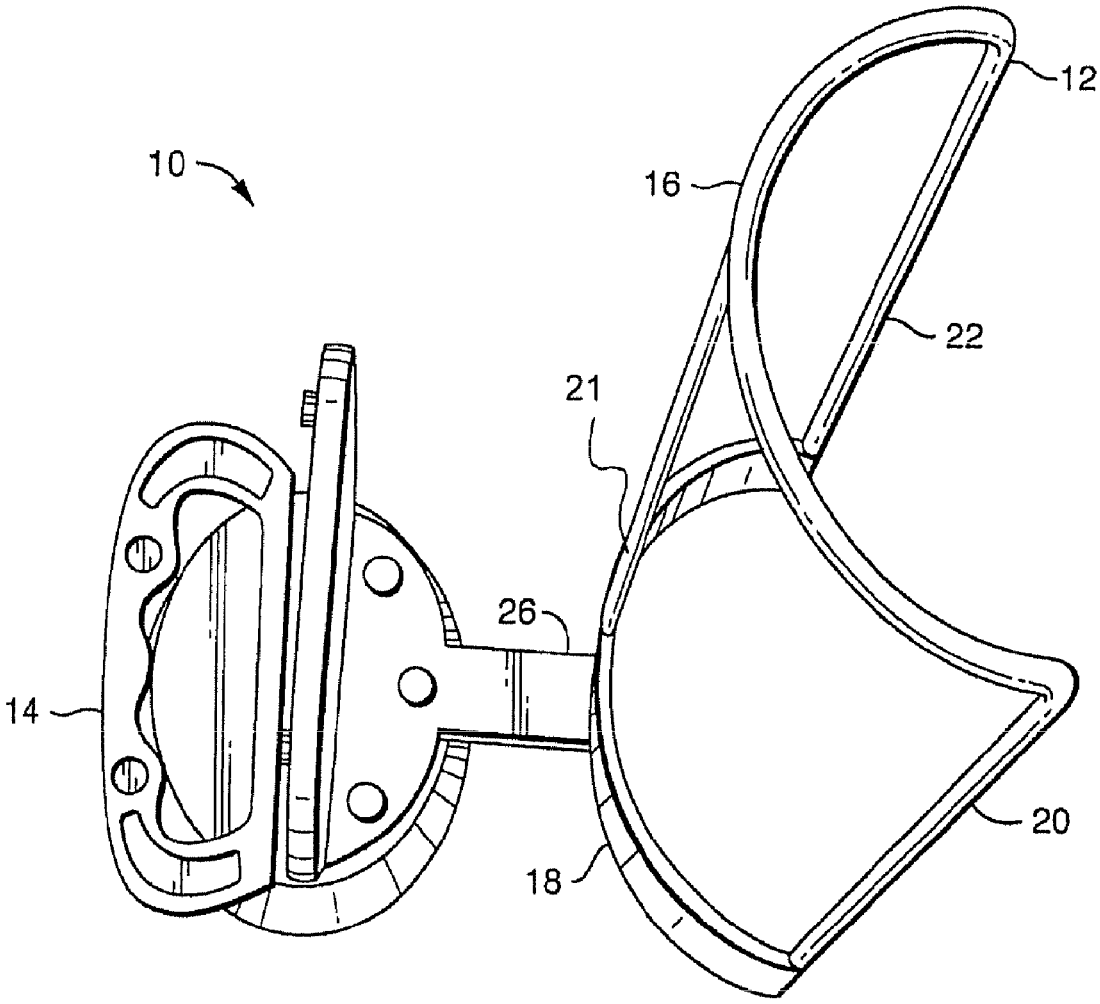
FIG. 2 is a top perspective view of the donning assist device illustrated in FIG. 1.

In the embodiment illustrated in FIGS. 1 and 2, the side walls 20 and 22 are curved such that the frame 12 has an arcuate-shaped cross section. It should be understood, however, that the open channel 24 can have various other shapes and configurations. For example, in an alternative embodiment, the side walls 20 and 22 may extend along a more linear path. In this embodiment, for instance, the frame 12 may have more of a polygon-like cross sectional shape. For example, in one embodiment, the frame 12 may have an open rectangular cross sectional shape.

In general, the cross sectional shape of the frame 12 is intended to partially encircle an individual's extremity, such as an arm or leg. As will be described in greater detail below, the shape is also used to form an opening in a compression garment for insertion of an extremity.

The amount the side walls 20 and 22 of the frame 12 are extended may vary depending upon the particular application and various factors. When the frame 12 has an arcuate-shaped cross section, for instance, the side walls may extend from about 120° to about 210°, such as from about 150° to about 175°. In the embodiment illustrated in FIGS. 1 and 2, for instance, the frame 12 forms a substantially open half cylindrical configuration.

As shown in FIGS. 1 and 2, the frame 12 can also include a back member 21. The back member 21 not only stabilizes the frame but can prevent an extremity, such as an arm or a leg, from swinging behind the frame during the donning of a compression garment.

The frame 12 can be made from various different materials as long as the frame has sufficient rigidity to hold a compression garment. In the embodiment illustrated in FIGS. 1 and 2, the frame 12 is made from metal rods and metal bars. In one embodiment, for instance, stainless steel may be used to form the frame. When forming the frame from rods and bars, the frame generally has an open structure as shown in the figures.

Alternatively, the frame 12 can be made from a solid material. For example, the frame can also be made from a single piece of metal or from a structural plastic material. When formed from a plastic material, the frame can be made from any suitable polymer. For instance, the frame can be made from a polyolefin, a polyester, a polyamide, a polycarbonate, a polystyrene, a copolymer thereof, or mixtures thereof. In one embodiment, for instance, the frame 12 can be made from a single continuous piece of plastic comprised of a copolyester, such as PETG.

In one embodiment, the frame 12 can be made from a single piece of solid material that includes a first surface that defines the open channel and a second and opposite surface. In one configuration, the first surface can be relatively smooth, while the opposite second surface can be textured. The second surface can be textured so as to better hold a compression garment in place while the garment is being donned by a user. The second side of the frame 12 can be textured using any suitable technique. For instance, the mold used to form the plastic material may include undulations that create a textured surface on the second side.

In the embodiment illustrated in FIGS. 1 and 2, the open channel 24 formed by the frame 12 generally has the same dimensions or size from the top 16 of the frame to the bottom 18. In other embodiments, however, the open channel 24 may taper in one direction. For instance, the open channel 24 may decrease in size from the top 16 to the bottom 18.

In order to hold the frame 12 in place while a compression garment is placed over the frame and donned by a user, the garment donning assist device includes the mounting member 14. In the embodiment illustrated in FIGS. 1 and 2, for instance, the mounting member 14 is connected to the frame 12 by an extension member 26. In this embodiment, the extension member 26 connects the frame 12 to the mounting member 14 so that the mounting member can be attached to a horizontal surface for holding the frame 12 in place during use. In an alternative embodiment, however, the mounting member may be rotated 90° such that the mounting member is configured to attach the frame 12 to a vertical surface as opposed to a horizontal surface. In still another embodiment, the mounting member 14 may pivot with respect to the frame for mounting the frame either to a horizontal surface or to a vertical surface. For example, in this embodiment, the mounting member may pivot between a horizontal position and a vertical position and locked into place depending upon the particular configuration.

In general, any suitable mounting member may be used to hold the frame 12 in place during use. In one embodiment as shown in FIGS. 1 and 2, for instance, the mounting member 14 may comprise a suction holder or suction cup that is capable of attaching to any flat surface. Various suction cups are available commercially. For instance, in one embodiment, the suction cup 14 may comprise a VERIBOR suction holder commercially available from the Bohl Corporation.

The use of a suction cup as the mounting member 14 provides advantages in that the suction cup can be easily secured to a surface and released from the surface. Thus, the use of a suction cup allows for the device to be portable.

In addition to suction cups, however, the mounting member may comprise various other devices. For example, in an alternative embodiment, the mounting member 14 may comprise a clamp, such as a C-clamp. In still another alternative embodiment, the mounting member may comprise one or more legs, such as a weighted base that provides sufficient stability to don the compression garment. In still another embodiment, the mounting member 14 may comprise a base that is affixedly secured to a surface such as through the use of screws or bolts.

Figure 3:
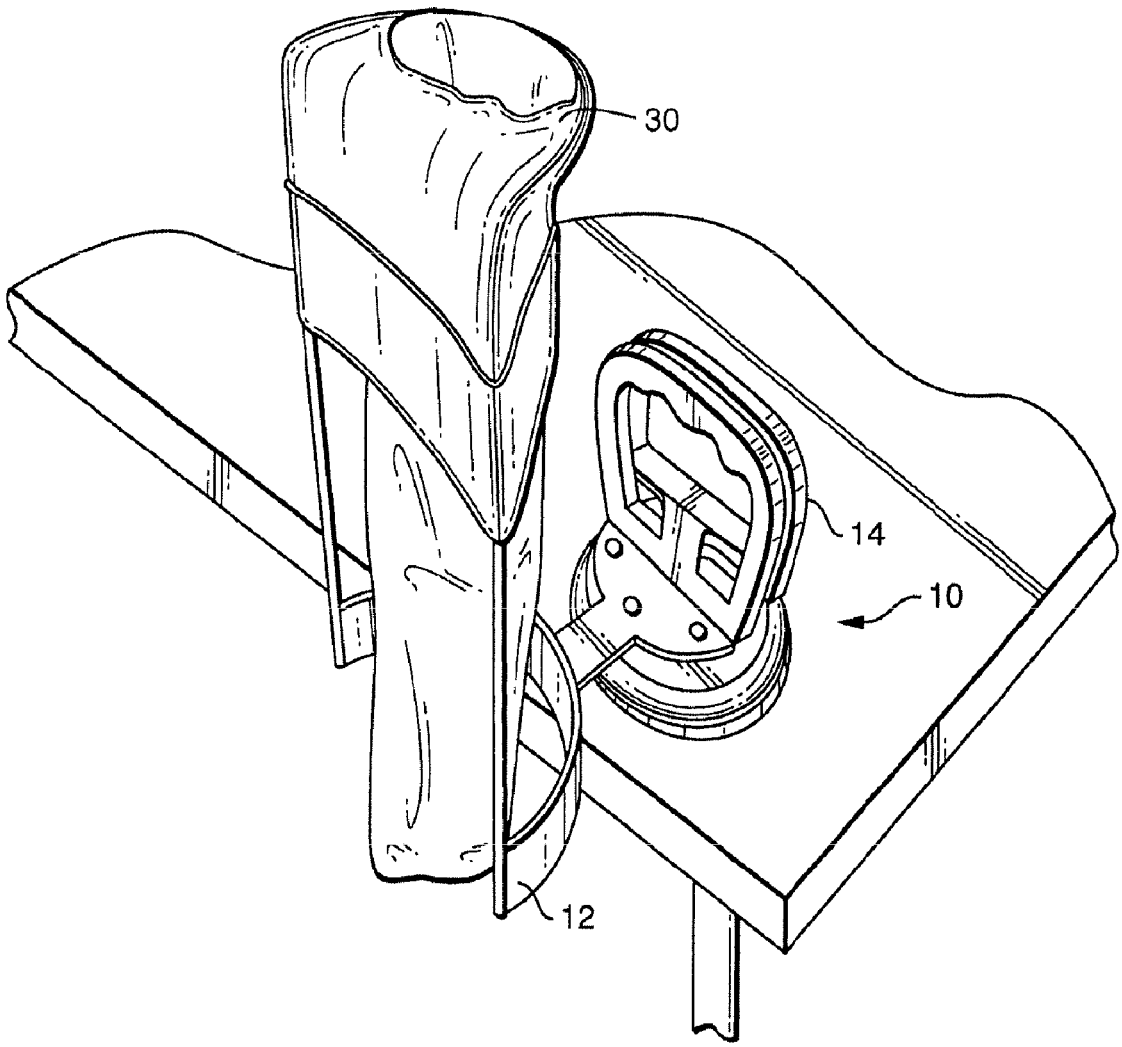
FIG. 3 is a perspective view of one embodiment of a donning assist device made in accordance with the present disclosure illustrating a compression sleeve being placed on the device.
Figure 4:
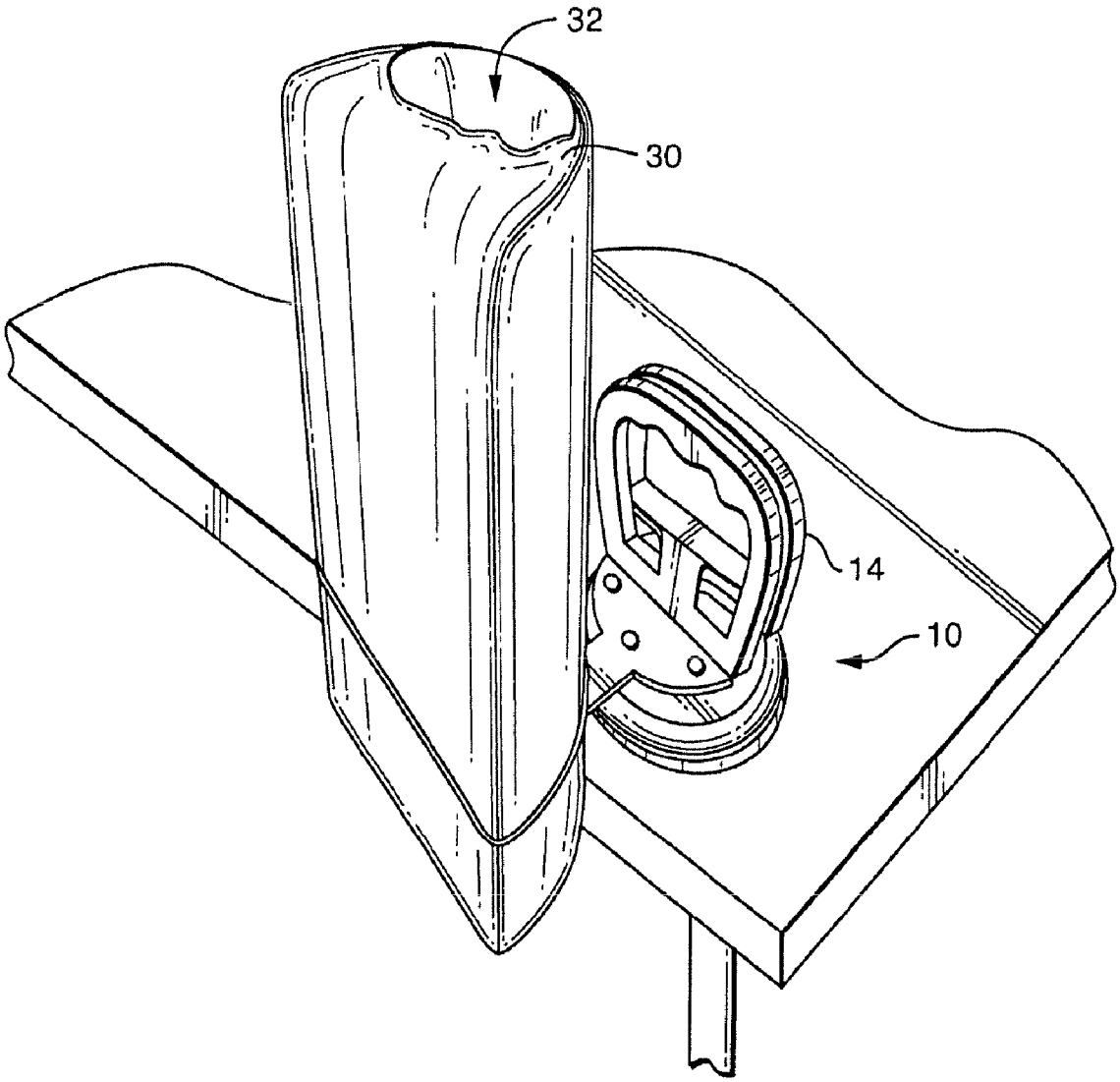
FIG. 4 is a perspective view of one embodiment of a garment donning assist device made in accordance with the present disclosure showing a compression sleeve positioned on the device and ready for receiving an extremity of a patient, such as an arm.
Figure 5:
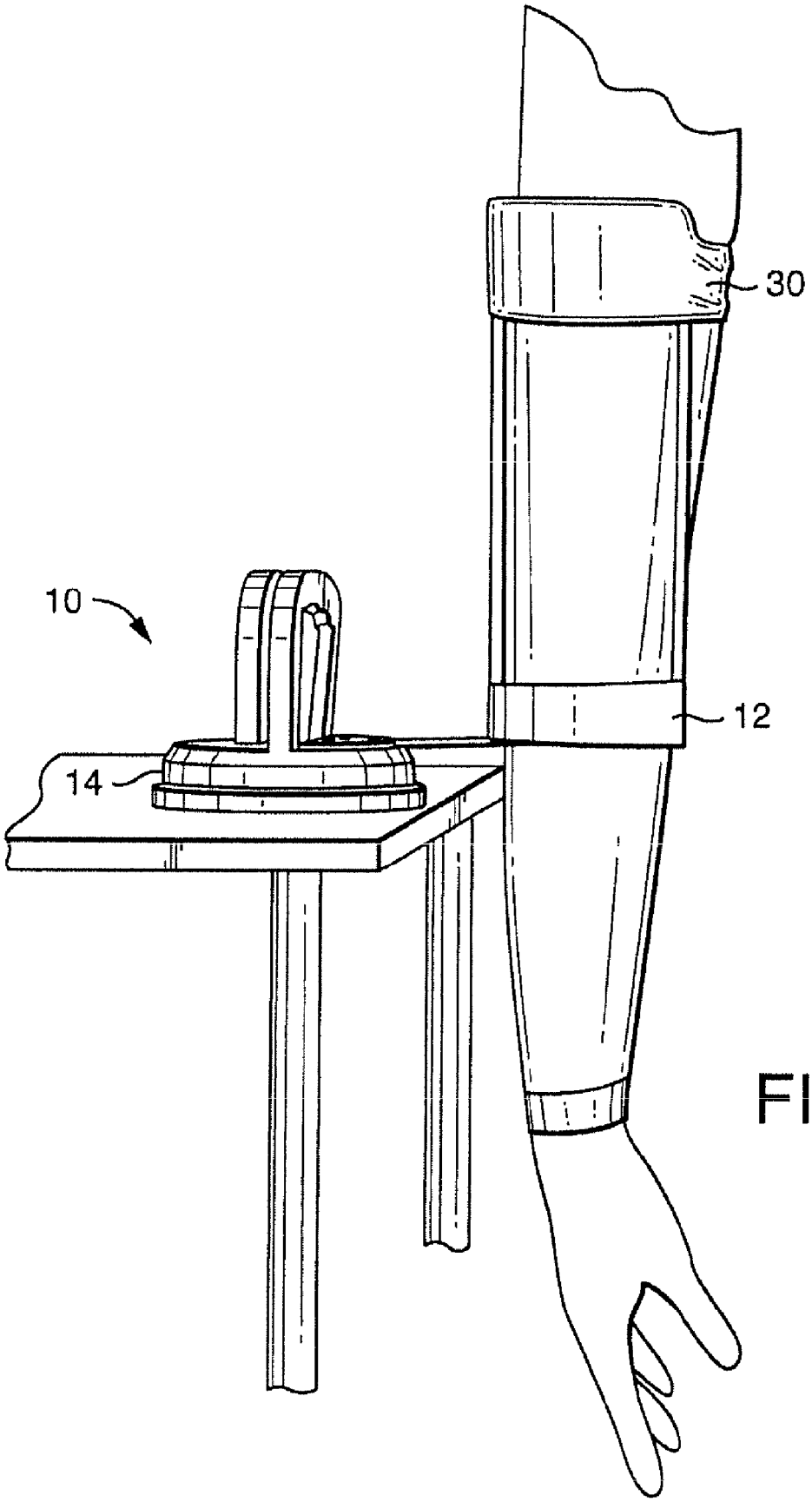
FIG. 5 is a perspective view of one embodiment of a garment donning assist device made in accordance with the present disclosure illustrating an arm being inserted into a compression sleeve positioned on the device.

In operation, the garment donning assist device 10 can be used to don a compression garment to an upper or lower extremity. The device aids in donning compression garments where strength or medical conditions inhibit the compliance of donning because of the difficulty in pulling the garment completely up one's arm or leg. One method of using the garment donning assist device 10 is illustrated in FIGS. 3 through 5. In FIGS. 3 through 5, a compression garment or sleeve 30 is shown being positioned over a user's arm.

Referring to FIG. 3, in order to use the garment donning assist device 10, the mounting member is first secured to the edge of a smooth flat surface, such as a table. The compression sleeve 30 is then prepared for application to the device. In general, the device can be used with any compression sleeve. The compression sleeve, for instance, generally comprises an elastic tubular garment.

Compression sleeves, for instance, can be formed from various materials. Desirably, the compression sleeve stretches in at least two different directions. Materials that may be used to form the compression sleeve include, for instance, elastic foam materials, woven materials, knitted materials, films, and combinations thereof. For example, in one embodiment, the compression sleeve comprises a knitted fabric containing elastic threads, yarns or filaments. Alternatively, the compression sleeve 30 may comprise a woven fabric containing elastic yarns. In still another embodiment, the compression sleeve 30 may comprise an elastic film alone or in combination with various woven and nonwoven materials. For example, in one embodiment, the compression sleeve may comprise an elastic film bonded to a stretchable fabric.

As shown in FIG. 3, once the garment donning assist device 10 is secured to a surface, the compression sleeve 30 is partially folded inside out and folded over the top of the frame 12. As shown in FIG. 4, the compression garment 30 can then be pulled over the entire length of the frame 12 of the garment donning assist device 10 if desired. In this manner, a significant portion of the compression sleeve 30 remains inside out while mounted on the frame 12. Having a portion of the compression sleeve inside out produces an outstretched opening 32 that is for receiving the arm of a user.

As shown in FIG. 5, a user can then insert his or her arm into the outstretched opening 32. The open channel formed by the frame 12 can be designed so as to produce the opening 32 having dimensions that facilitate insertion of the arm. Specifically, the arm slides into the compression sleeve 30. The arm is then pushed down through the compression sleeve which causes the compression sleeve 30 to slide off of the frame 12 and onto the arm of the user. More particularly, as the arm is pushed down through the garment donning assist device 10, the compression sleeve 30 slides up the device and over the arm. As the user pushes through the garment donning assist device, the compression sleeve 30 is ultimately rolled up just below the shoulder. Because the frame 12 forms an open channel, the arm can then easily disengage from the garment donning assist device as the compression sleeve also disengages from the device.

Figure 6:
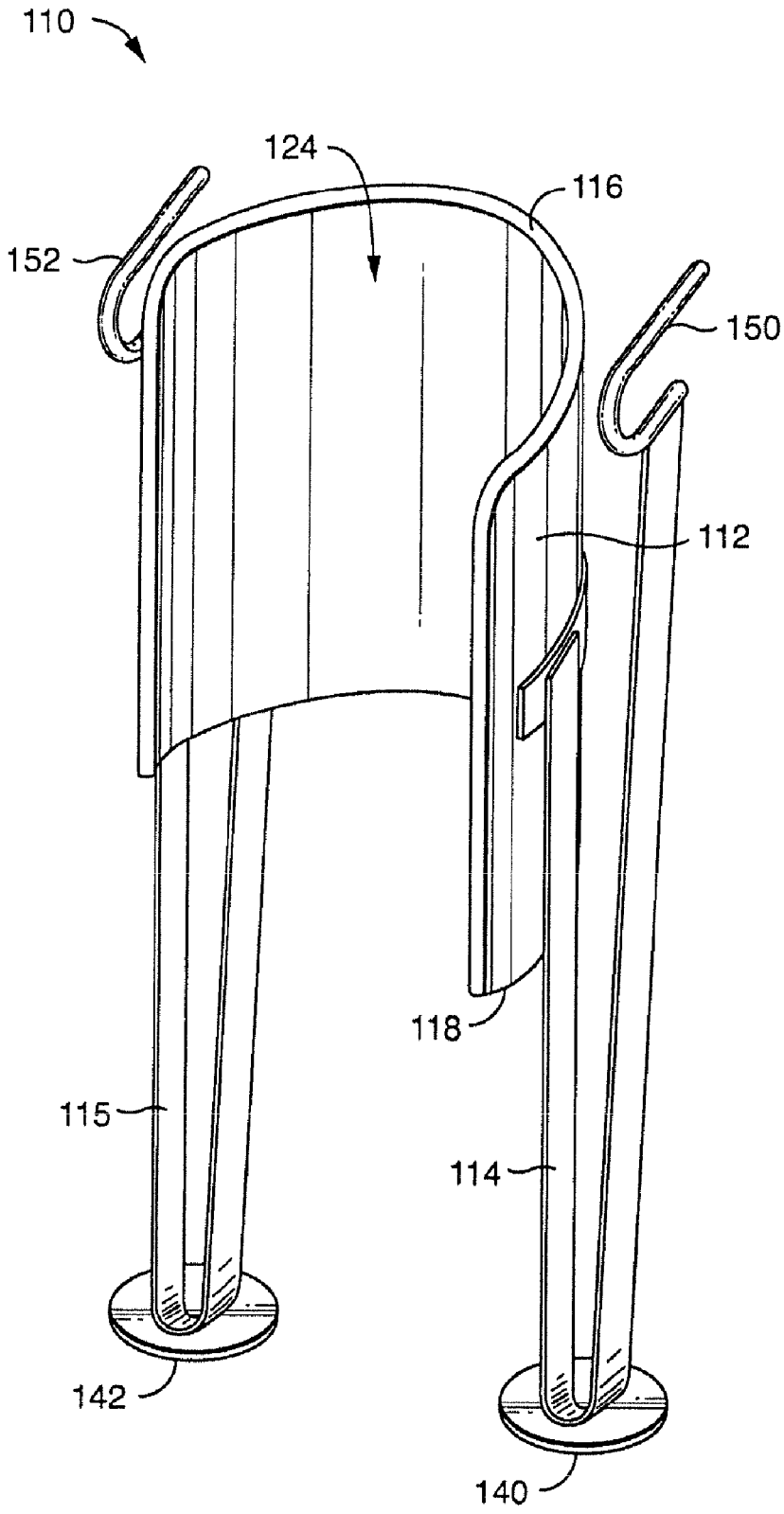
FIG. 6 is a perspective view of another embodiment of a garment donning assist device made in accordance with the present disclosure.

Referring to FIG. 6, an alternative embodiment of a garment donning assist device 110 is shown. The garment donning assist device illustrated in FIG. 6 is particularly well suited for donning compression stockings to be placed over an individual's leg.

As shown, the garment donning assist device 110 includes a rigid frame 112 having a top 116 and a bottom 118. In this embodiment, the frame 112 is made from a solid piece of material, such as a polymer. The frame 112 defines an open channel 124 for receiving an extremity, such as a leg.

The frame 112 is connected to mounting members 114 and 115 which, in this embodiment, comprise legs. The mounting member 114, for instance, is attached to a first base 140, while the second mounting member 115 is attached to a second base 142. The mounting members 114 and 115 maintain the frame at a desired height and position and mount the frame against the floor.

As shown in FIG. 6, each mounting member 114 and 115 is further attached to a corresponding handle 150 and 152 respectively. The handles 150 and 152 are positioned on opposite sides of the frame 112. In the embodiment shown, each mounting member or leg extends downwardly from the frame and is attached to a base which provides expanded footing. Each leg then curves in an upwards direction and attaches to the handles 150 and 152. In this embodiment, for instance, each of the mounting members 114 and 115 may be made from a bent flat metal bar. The handles 150 and 152 are positioned so that an individual can grasp the handles and place one's foot through the open channel formed by the frame and into a compression garment that has been placed over the top of the frame as described above with respect to FIG. 3.

When in use, one can insert a leg into a compression garment properly placed on the frame. By pushing one's leg down through the garment, the garment releases from the frame and remains properly positioned on the leg.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. An extremity garment donning assist device comprising:

a rigid frame having an open cylindrical configuration, the rigid frame including a top and a bottom;

a suction cup connected to the rigid frame, the suction cup for releasably mounting the garment donning assist device onto a surface, and wherein the rigid frame has a size such that a compression sleeve can be slid over the top leaving an outstretched opening, the opening for allowing a person to slide one's extremity into the compression sleeve for donning the same; and wherein the rigid frame is configured so that the extremity passes through the top and extends past the bottom of the rigid frame such that the compression sleeve is completely removed from the rigid frame and placed on the extremity as the extremity passes through and extends below the bottom of the rigid frame past the suction cup.

2. An extremity garment donning assist device as defined in claim 1, wherein the rigid frame has a half cylindrical configuration.

3. An extremity garment donning assist device as defined in claim 1, wherein the rigid frame is formed from steel rods.

4. A process for donning a compression sleeve comprising:

placing a compression sleeve over the top of the garment donning assist device defined in claim 1, the compression sleeve being placed over the top of the garment donning assist device and pulled down the device so as to form an outstretched opening; and inserting an arm into the outstretched opening of the compression sleeve and pushing down through the compression sleeve thereby causing the compression sleeve to slide up and off the garment donning assist device and over the arm.

5. An extremity garment donning assist device comprising:

a rigid frame having a top, a bottom, and a pair of side walls, the side walls extending outwardly to define an open channel that extends from the top to the bottom of the rigid frame;

at least one mounting member for releasably mounting the rigid frame against a surface, and wherein the rigid frame has a size such that a compression sleeve can be slid over the top leaving an outstretched opening, the opening for allowing a person to slide one's extremity into the compression sleeve for donning the same; and wherein the rigid frame is configured so that the extremity passes through the open channel and extends past the bottom of the rigid frame such that the compression sleeve is completely removed from the rigid frame and placed on the extremity as the extremity passes through the open channel and extends below the bottom of the rigid frame past the mounting member.

6. An extremity garment donning assist device as defined in claim 5, wherein the side walls of the rigid frame are curved such that the rigid frame has an arcuate-shaped cross section.

7. An extremity garment donning assist device as defined in claim 6, wherein the arcuate-shaped cross section of the rigid frame extends from about 120° to about 210° in defining the open channel.

8. An extremity garment donning assist device as defined in claim 6, wherein the arcuate-shaped cross section of the rigid frame extends from about 150° to about 175° in defining the open channel.

9. An extremity garment donning assist device as defined in claim 5, wherein the rigid frame comprises a solid plastic member made from a polymer.

10. An extremity garment donning assist device as defined in claim 9, wherein the plastic member includes a first side that defines the open channel and a second and opposite side, the first side having a smooth surface, while the second side having a textured surface wherein the texture of the second side holds the garment in place with respect to the donning device.

11. An extremity garment donning assist device as defined in claim 5, wherein the rigid frame comprises an open frame made from metal rods, metal bars, or mixtures thereof.

12. An extremity garment donning assist device as defined in claim 5, wherein the mounting member comprises a suction cup.

13. An extremity garment donning assist device as defined in claim 5, wherein the at least one mounting member comprises a first leg and a second leg for mounting the device to a floor.

14. An extremity garment donning assist device as defined in claim 5, wherein the mounting member is movable relative to the rigid frame for mounting the extremity garment donning assist device on a horizontal surface or on a vertical surface.

15. An extremity garment donning assist device as defined in claim 5, wherein the mounting member is connected to the rigid frame near the bottom of the frame.

16. An extremity garment donning assist device as defined in claim 5, wherein the open channel has substantially the same size from the top of the rigid frame to the bottom of the rigid frame.

17. An extremity garment donning assist device as defined in claim 5, wherein the open channel tapers from the top of the rigid frame to the bottom of the rigid frame.

18. An extremity garment donning assist device as defined in claim 5, further comprising an extension member for connecting the mounting member to the rigid frame, the mounting member being positioned for mounting the extremity garment donning assist device to a horizontal surface.

19. An extremity garment donning assist device as defined in claim 13, further including a pair of handles.

20. An extremity garment donning assist device as defined in claim 19, wherein each handle extends from a corresponding leg, the handles extending upwards and being positioned on opposite sides of the rigid frame.

21. An extremity garment donning assist device as defined in claim 5, wherein the mounting member comprises a clamp.

22. An extremity garment donning assist device as defined in claim 5, wherein the frame further comprises a back stabilizing member.

23. A process for donning a compression sleeve comprising:

placing a compression sleeve over the top of the garment donning assist device defined in claim 5, the compression sleeve being placed over the top of the garment donning assist device and pulled down the device so as to form an outstretched opening; and inserting an arm into the outstretched opening of the compression sleeve and pushing down through the compression sleeve thereby causing the compression sleeve to slide up and off the garment donning assist device and over the arm.

* * * * *